US005204680A

United States Patent [19]

Allington et al.

[11] Patent Number: 5,204,680

[45] Date of Patent: Apr. 20, 1993

[54] RADAR REFLECTING TARGET FOR REDUCING RADAR CROSS-SECTION

[75] Inventor: Marcus L. Allington; Peter W. East, both of Surrey, United Kingdom

[73] Assignee: Racal Defence Electronics (Radar) Limited, Surrey, United Kingdom

[21] Appl. No.: 775,950

[22] PCT Filed: Apr. 26, 1990

[86] PCT No.: PCT/GB90/00647

§ 371 Date: Oct. 24, 1991

§ 102(e) Date: Oct. 24, 1991

[87] PCT Pub. No.: WO90/13926

PCT Pub. Date: Nov. 15, 1990

[30] Foreign Application Priority Data

Apr. 28, 1989 [GB] United Kingdom ..... 8909768

[51] Int. Cl.[5] ..... H01Q 15/14; H01Q 17/00

[52] U.S. Cl. ..... 342/4; 342/6

[58] Field of Search ..... 342/1, 4, 5, 6, 7

[56] References Cited

U.S. PATENT DOCUMENTS 4,501,784 2/1985 Moshinsky ..... 428/156

5,057,842 10/1991 Möller et al. ..... 342/4

FOREIGN PATENT DOCUMENTS 1119348 12/1961 Fed. Rep. of Germany .

3543687A1 6/1987 Fed. Rep. of Germany .

1074899 7/1967 United Kingdom .

OTHER PUBLICATIONS

Marc Piette, *Revetement Interferentiel Pour Char,* 1986.

Hans Dominik, *Hochfrequenz-absorbierende Materialien,* 1988.

*Primary Examiner*—T. H. Tubbesing

*Attorney, Agent, or Firm*—Kinney & Lange

[57] ABSTRACT

A radar reflecting target comprises a plurality of reflecting elements spread along at least one linear physical dimension of the target, the elements being differingly spaced in the direction normal to said dimension so that respective retro-reflections by the elements of radio frequency energy from a remote source on a line of sight at an angle to said dimension, have differing phases and tend to cancel each other out. The invention may be applied to single or two dimensional surfaces on such vehicles as ships or aeroplanes.

10 Claims, 4 Drawing Sheets

TARGET AT 0 DEGREES ELEVATION

RADAR REFLECTING TARGET FOR REDUCING RADAR CROSS-SECTION

TECHNICAL FIELD

The present invention is concerned with a radar reflecting target and particularly such target for reducing radar cross-section (RCS).

BACKGROUND ART

There is a desire to minimize the RCS of particularly, military vehicles such as planes, ships and tanks. Known schemes for so doing include:

1) forming radar reflecting surfaces of the vehicle to be spherical to encourage isotropic reflection, 2) tilting of flat features of the reflecting surface of the vehicle away from normal incidence for expected incoming radar signals and removing as far as possible dihedral and trihedral corner reflectors from the vehicle shape, 3) fitting absorbing layers on metallic surfaces to attenuate the reflecting signal, and 4) active cancellation whereby coherent signals are transmitted which are electronically adjusted to cancel out the reflected signal.

The present invention is concerned with a technique employing passive cancellation of radar return signals, providing a cheap and effective solution.

DISCLOSURE OF THE INVENTION

According to the present invention, a radar reflecting target comprises a plurality of reflecting elements spread along at least one linear physical dimension of the target, the elements being differingly spaced in the direction normal to said dimension so that respective retro-reflections by the elements of radio frequency energy from a remote source on a line of sight at an angle to said dimension, have differing phases and tend to cancel each other out. In this broadest aspect, the invention is applicable to essentially single dimension targets, e.g. spars on ships or possibly the wing leading edges of aeroplanes. By dividing the reflecting target into a plurality of individual reflecting elements as defined above, reflections from the different elements tend to cancel each other out, thereby reducing the radar visibility of the target. Preferably, the elements are differingly spaced in said normal direction evenly, and more preferably with a random or pseudo-random distribution, over at least one half wavelength of the expected radio frequency energy from the remote source. This allows operation over a wide signal frequency band.

More normally, the invention is applicable to two-dimensional targets wherein the reflecting elements are spread over two orthogonal physical dimensions of the target and are then differingly spaced normal to the plane of said orthogonal dimensions. It can be shown that this technique when suitably employed can reduce the effective reflection gain of a two dimensional target to that of a single one of the reflecting elements. Because the reflecting elements are all differingly spaced in the direction normal to the plane of the target, retro-reflections from the different elements experience different path lengths before recombining in a retro-reflection signal. The different path lengths are spread over one wavelength and, generally, there will always be a pair of reflecting elements providing a path length difference of one half wavelength so that the retro-reflections from each of these cancel out.

Preferably, the reflecting elements are electrically conductive plates arranged to appear substantially tesselated when viewed normal to said plane. Conveniently the electrically conductive plates are mutually parallel and square.

The target can readily be formed of a molded panel of dielectric material having flat surface portions bearing electrically conductive film to form said plates. These panels may be formed cheaply and can be light in weight.

In one arrangement, the differingly spaced elements in the moulded panel are distributed randomly or pseudo-randomly over the panel. Then, several panels may be used abutting each other to cover an extensive reflective surface of a military vehicle, e.g. the superstructure of a ship. A single design of panel can be orientated in up to eight different ways and provide eight corresponding different arrangements of spaced elements, thereby reducing the risk of several panels correlating with one another and increasing the radar cross-section.

Conveniently, however, said differingly spaced elements are distributed across the panel to provide a null for retro-reflection normal to said plane. One way of achieving this is by distributing the elements with mirror asymmetry. By mirror asymmetry it is meant that the panel is divided into four quadrants by two orthogonal dividing lines intersecting at the center of the panel. Then any reflective element in one quadrant has a complementary reflective element in each of the adjacent quadrants at the same distance from the respective intervening dividing line, but having a depth relative to a reference plane of the panel modified to produce a phase difference in the reflected signal of plus or minus $\pi$ radians (relative to the expected frequency of an incoming radar signal).

A satisfactory null over a reasonable bandwidth can be achieved in this way. However, to provide a broadband null, adjustable spacing means may be included which are responsive to the measured frequency of radio frequency energy detected from a remote source to adjust said spacing normal to said plane of at least some of said differingly spaced elements to provide said null at the measured frequency.

The mirror asymmetry arrangement described above need not be confined to dividing up separate panels into quadrants. If, for example, a panel of 16 elements per side is employed, each quadrant is then 8 elements per side and can itself be sub-divided into "sub-quadrants" in the same manner. Also, a complete panel may be formed as one quadrant of a larger formation of four panels. Thus the build up of quadrants produces a series of nulls at selected frequencies.

Generally, the two dimensional targets described above, may be formed as screening panels for mounting on a radar reflecting surface to reduce its reflection gain. It will be appreciated that with a finite number of different reflecting elements, such a target provides for any frequency over a range of frequencies a plurality of retro-reflection minima at specific retro-reflection angles relative to said plane defined by the screening panel. These specific retro-reflection minima angles may be calculated from first principles, but may preferably be determined empirically for a particular design of screening panel. Then, it is convenient if the target is made to include adjustable mounting means, responsive to the measured frequency and angle of incidence of radio frequency energy detected from a remote source, to adjust the angle of said plane relative to the radar reflecting surface so as to steer a retro-reflection minima on to said measured angle of incidence. It may be sufficient for the adjustable mounting means to allow an adjustment of only 10° to be sufficient to steer the nearest minima on to an angle of incidence over a full 180° range.

BRIEF DESCRIPTION OF DRAWINGS

An example of the invention will now be described in more detail with reference to the accompanying drawings in which.

BEST MODE FOR CARRYING OUT THE INVENTION

Figure 1:
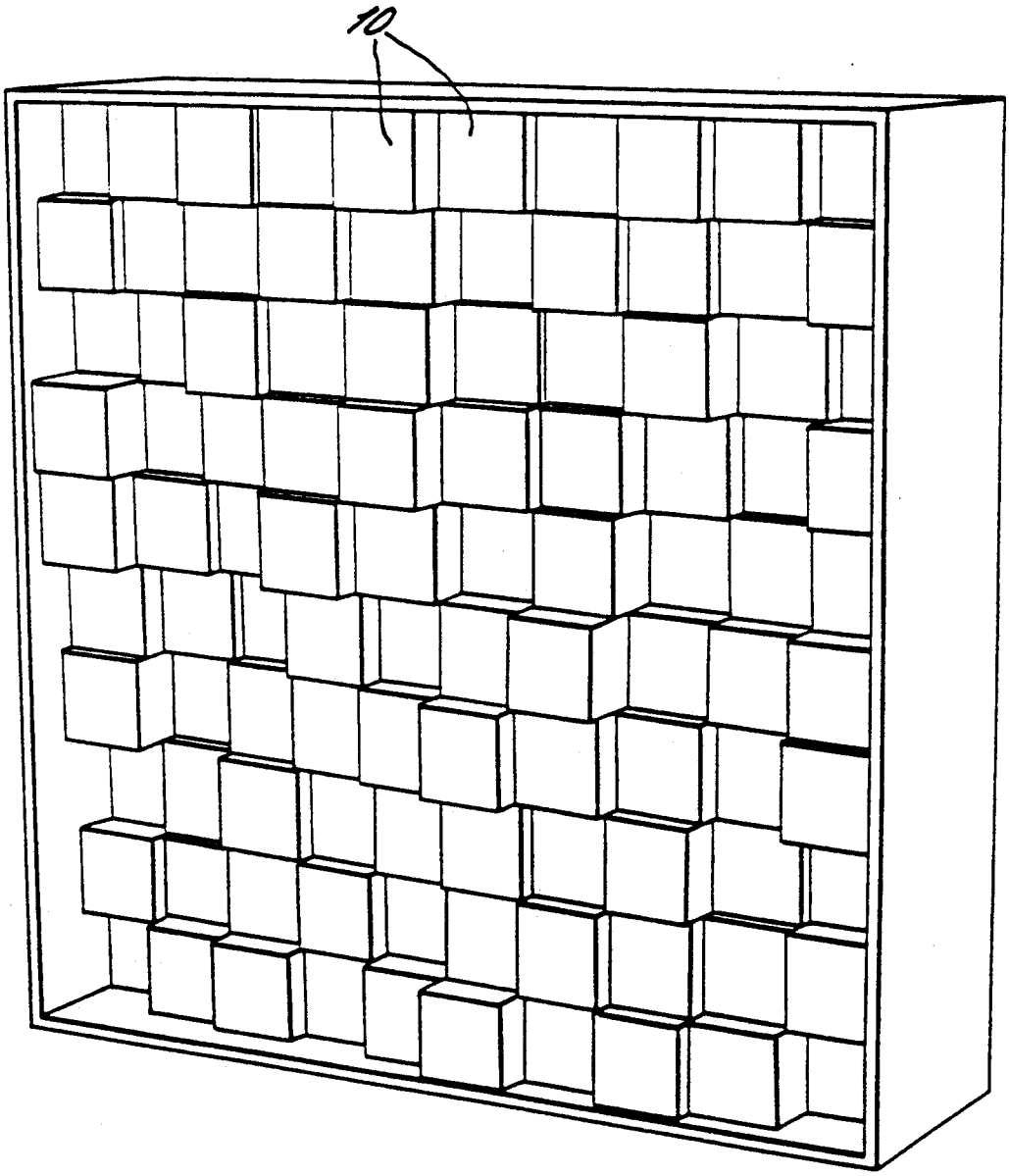
FIG. 1 is a perspective view of a two-dimensional screening panel embodying the invention.

FIG. 1 shows in perspective view a radar reflecting target formed as a screening panel. The target comprises a multiplicity of separate radar reflective elements arranged in a square 10 by 10 matrix. Each reflective element is a square plate 10 of electrically conductive material, typically aluminium. As can be seen in FIG. 1, the individual elements 10 are located at differing spacings or depths in the direction normal to the general plane of the panel. The spacing variation can best be seen in FIG. 2 which is a cross-sectional view through one column of the elements of FIG. 1.

Figure 2:
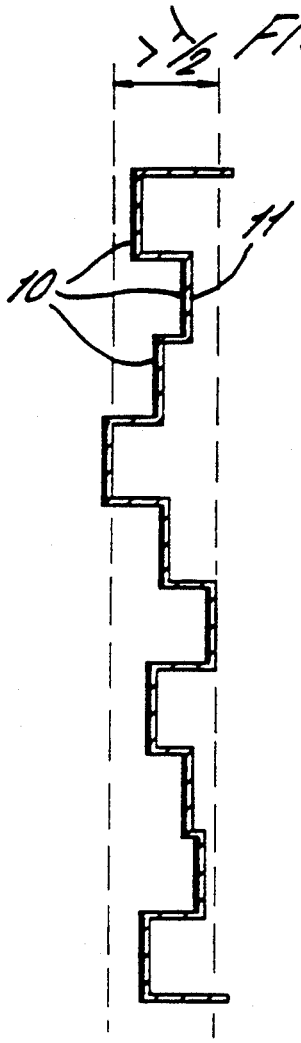
FIG. 2 is a cross-sectional view through one column of reflective elements in the panel of FIG. 1.

The panel is conveniently formed by moulding the required substrate shape from a sheet of moldable plastics material to form the substrate 11 in FIG. 2. The square reflective elements 10 are then applied to the square flats formed on the substrate 11. The panel is conveniently covered by a signal transparent membrane, or filled with low-loss, low dielectric foam material, to present a smooth face.

Figure 3:
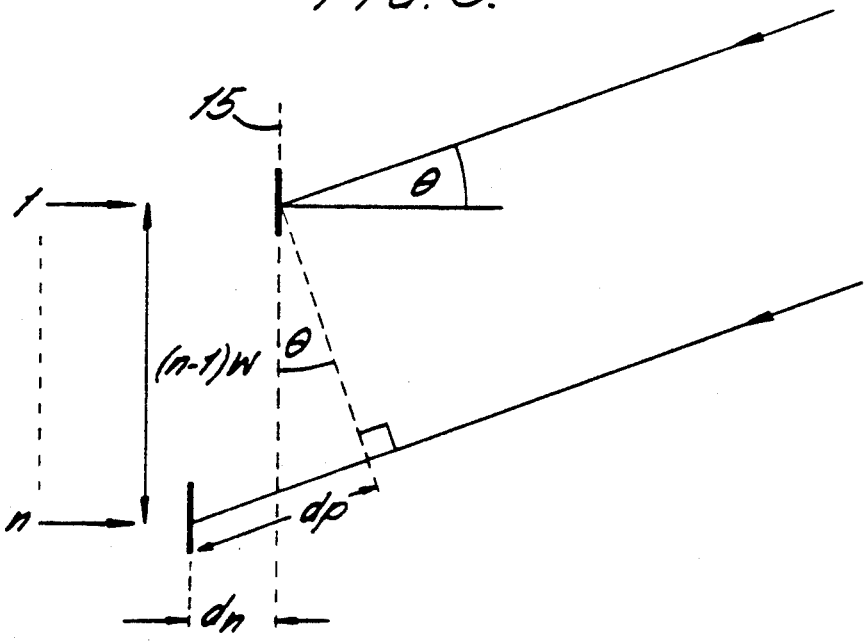
FIG. 3 is a geometrical drawing to illustrate the phase relationship of retro-reflected energy from two reflective elements of a target embodying the present invention.

Referring to FIG. 3, the geometry of the sum of retro-reflective energy from two elements (1 and n) from an array of elements is illustrated. If each square element has a width w, then the elements 1 and n are spaced a distance (n−1)w apart. If element 1 is taken to lie in a reference plane represented by dotted line 15, then the spacing of element n behind the reference plane (its depth) is $d_n$.

Assuming the illuminating wave from the direction 2 r is uniform over the panel aperture, the incoming signal to the nth element (assumed square side w) relative to a new plane at 2 r to the panel front reference plane can be described by:

$$v_n = kwe^{-j\omega t}$$

where k is a constant

The reflected component at the $\theta$ plane will be delayed a distance 2 $d_p$ and is given by:

$$v_n 1 = kwe^{-j\omega t} \cdot e^{\frac{j2\omega d_p}{c}} \cdot f(\theta)$$

where $f^2(\theta)$ is the element directivity $$= \frac{4\pi w^2}{\lambda^2} \frac{\left(\sin\left(\frac{2w}{\lambda}\right)\pi\sin\theta\right)^2}{\left(\left(\frac{2w}{\lambda}\right)\pi\sin\theta\right)} \text{ — for a square element}$$

and the reflected signal phase is:

$$\begin{aligned}\phi_n &= 2\omega d_p/c \\ &= \frac{4\pi d_p}{\lambda} \\ &= \frac{4\pi}{\lambda}(d_n \cos\theta \cos e + \\ &\quad w((n-1)\sin\theta \cos e + (m-1)\sin e))\end{aligned}$$

where $\theta$ is the azimuth direction of signal arrival e is the elevation direction of signal arrival and n,m are the nth horizontal and mth vertical element of a two-dimensional panel.

The reflection gain of the panel is given by:

$$\begin{aligned}G_r &= \frac{\text{Reflected Power in Direction } \theta}{\text{Recieved Power}} \Big| \\ &\quad \text{at reference plane } \theta \\ &= \frac{\left(\sum_{nm} kwe \cdot e^{-j\omega t j\phi n} \cdot f(\theta)\right)^2}{\sum_{nm} (kw\, e^{-j\omega t})^2} \\ &= f^2(\theta) \frac{\left[\sum_{nm} e^{j\phi n}\right]^2}{nm}\end{aligned}$$

If $\phi_n$ is randomly distributed over $2\pi$ radians then:

$$\sum_{nm} e^{j\Phi} n = \sqrt{nm}$$

and the reflection gain is simply $f^2(\theta)$ i.e. that of a *single* element.

At a single frequency $\Sigma_{nm} e^{j\phi n}$ can be chosen to be zero on boresight ($\theta=0$, e=0) producing zero reflection gain and RCS in this direction.

On the other hand, if $d_p=0$ i.e. a flat panel, the reflection gain is:

$$= f^2(\theta) \frac{n^2 m^2}{nm}$$

$$= nm\, f^2(\theta).$$

The RCS of the panel $\sigma$ is defined by:

$$\sigma = G_r A$$

where A is the panel area.

Thus, theoretically and for a particular frequency of illuminating energy, the RCS of the panel is reduced compared to a flat plate of the same size by a factor corresponding to the total number of reflecting elements in the panel.

In practice, the element spacings or depths can never be completely random over the $2\pi$ radians phase range due to the finite number of elements and also the requirement of the panel to operate over a reasonable frequency range. However, if the field of view from the panel and the frequency range is restricted, then parameters can be optimized by modeling.

If the depth of each element in a panel is selected randomly, then there will be no reflection symmetry with respect to the panel normal. It can be seen therefore that a single panel can be orientated in eight directions (four rotational × two front and rear faces) to provide in effect a set of eight different panels for use together when screening an extensive flat surface of, for example, a large military vehicle such as a ship. If identical panels were to be used repeatedly over an extensive area, there would be correlation between the different panels which would reduce the effectiveness of the screening. In fact, only a few different designs of panel may be required to protect a very extensive flat area whilst avoiding any correlation.

Figure 4:
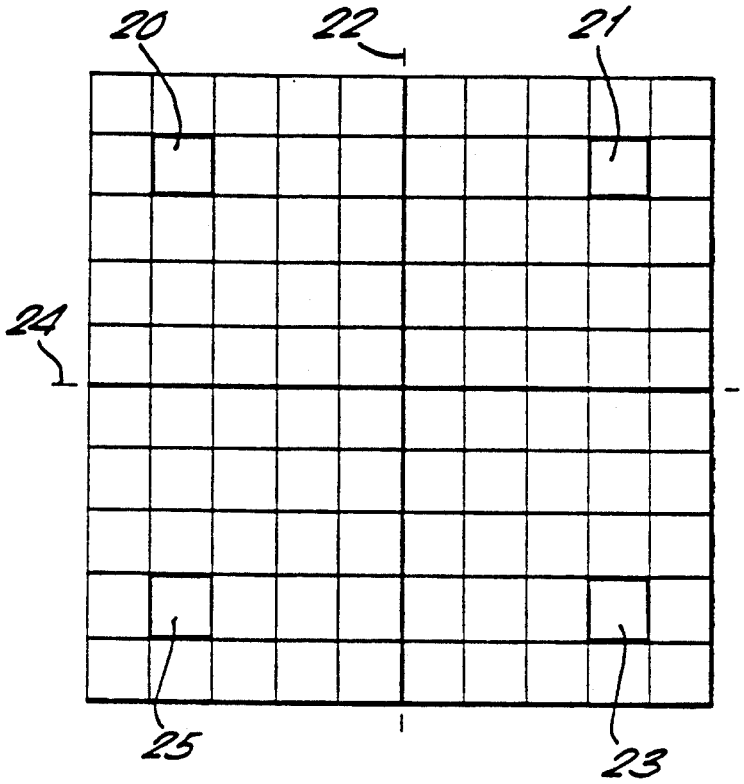
FIG. 4 is a plan view of the panel of FIG. 1 to illustrate the mirror asymmetry of reflective elements in a panel providing a null for retro-reflection along the normal to the plane of the panel.

If desired, a null for retro-reflection normal to the plane of the panel can be produced by dividing the panel such that for every random element depth chosen, there is a complementary element selected an equal distance on the opposite side of a panel dividing line with nominally the same depth modified to produce a phase difference in the reflected signal of plus or minus $\pi$ radians at the expected radar frequency. In a particular approach, the panel may be divided into four square areas such as illustrated in FIG. 4 and the element depths selected to provide mirror asymmetry. Thus, element 20 in the upper left hand quadrant of the panel may have a depth d relative to a reference plane. Then the corresponding element 21 in the mirror image position relative to the center line 22 should have a depth d plus or minus a quarter wavelength, i.e. a spacing corresponding to a phase difference $\pi$ in the reflected signal. The element 23 in the mirror image position to element 21 taken in the horizontal center line 24 has the same relationship and therefore will in fact have the same depth d as element 20. Similarly the element 25 in the lower left hand quadrant has a depth which is the same as that of element 21. This rule is applied to each of the elements in the quadrant. The resulting panel provides a useful degree of nulling on the normal to the panel plane over a fairly wide frequency band.

Figure 6:
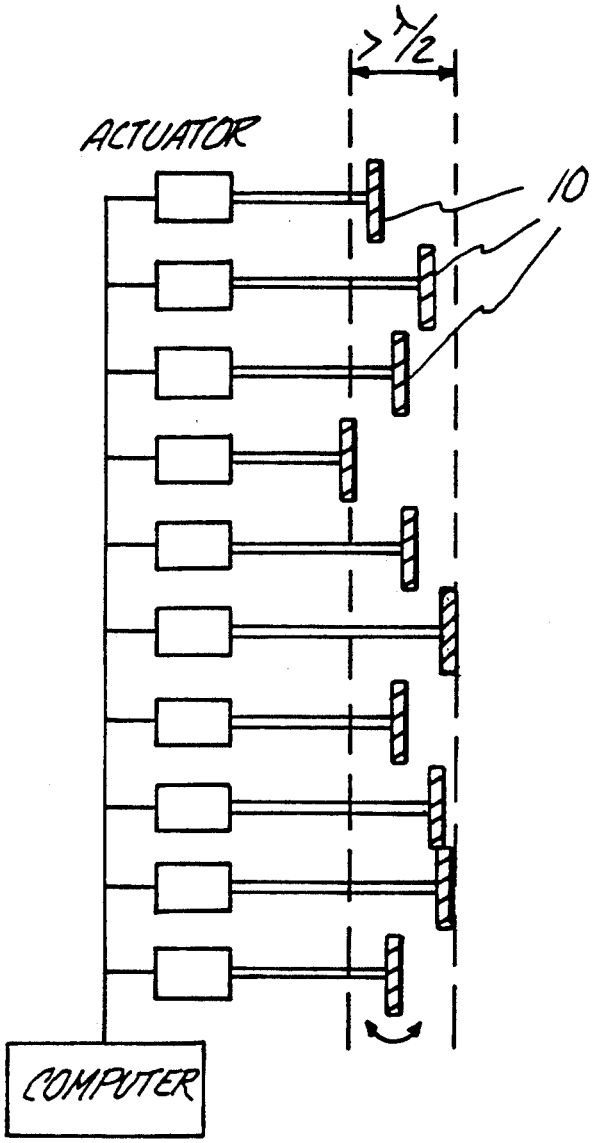
FIG. 6 is a side view of one column of reflective elements in the panel of FIG. 1.

Actuators fitted to similar quadrants enable adjustment of the relative depths to ensure a $\pi$ phase difference at any measured frequency. In this way measurement of signal frequency allows dynamic RCS adjustment to ensure a null in the normal direction so minimizing target RCS. These actuators may be computer controlled in response to the measured frequency of a detected threat radar (as shown in FIG. 6).

Industrial Applicability

It should be appreciated that panels made as described above can be used for screening parts of a vehicle or installation to reduce its radar cross-section. In the case of screening the superstructure of a ship, for example, a limited number of panels may be deployed to cover flat or low curvature structures starting with those highest on the superstructure. The broad side and bows and stern flashes typical of the RCS of ships can also be controlled in this way.

An important additional contributor to the RCS of any such platform is the presence of any 90° dihedral or trihedral corner reflectors. Panels as described above may be deployed on all but one of multiple reflection faces to provide significant improvement and reduction in retro-reflected energy. Preferably, all surfaces in dihedral or trihedral corner reflectors should be protected.

Figure 5:
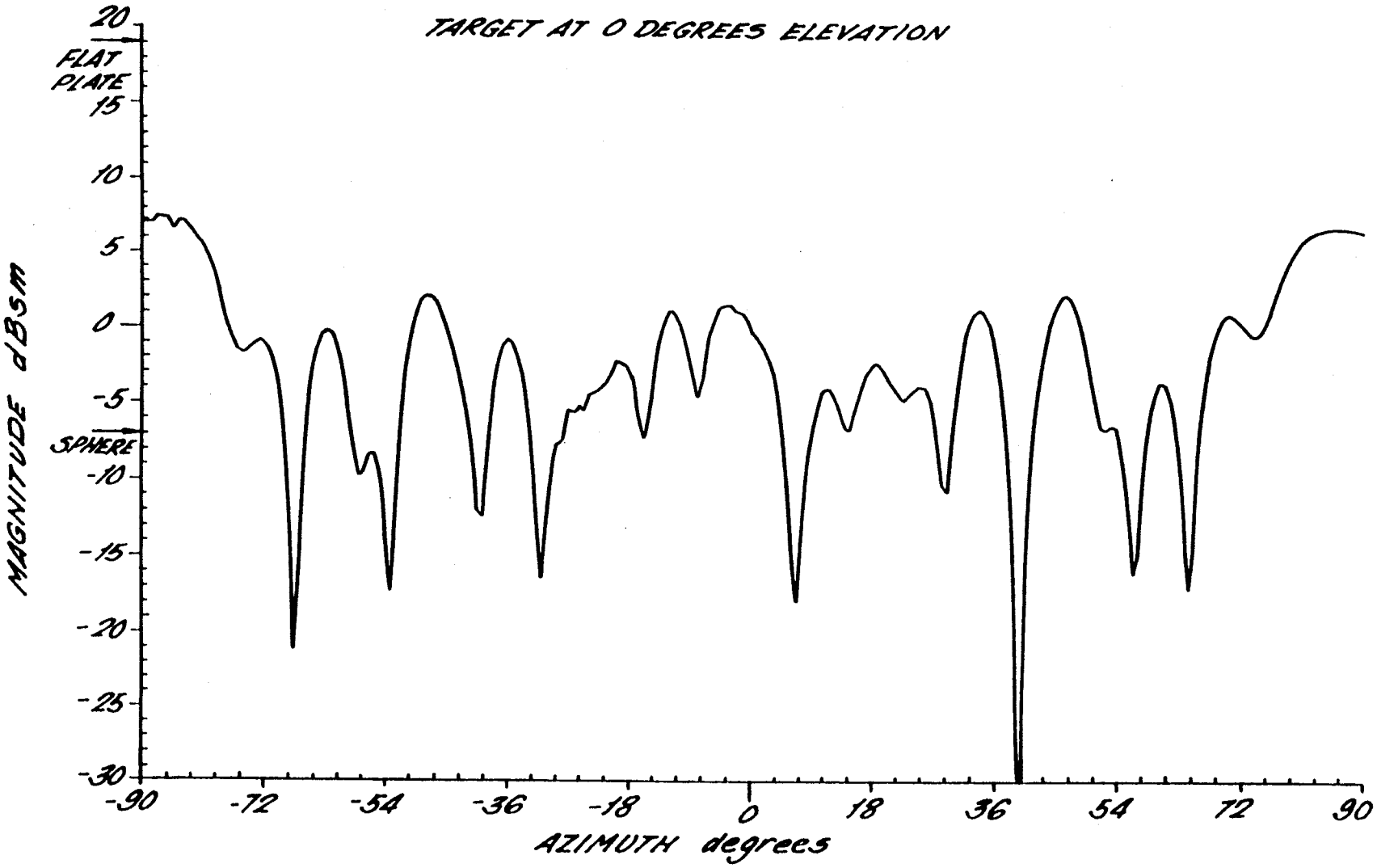
FIG. 5 is a graphical representation of the radar cross-section of a 100 element square panel as illustrated in FIG. 1 for various angles of incidence between plus and minus 90° to the normal.

A panel of the kind described above has been tested to determine its RCS over a range of azimuth angles relative to the plane of the panel from −90° to +90°. A graph illustrating the measured RCS is shown in FIG. 5. The Y axis is in decibels square meter (dBsm) and the RCS for a flat plate reflector of the same dimensions as the panel under test for normal reflection would be at about 19 dBsm on the scale of FIG. 5. The geometrical shape having the smallest RCS relative to its physical area subtended at the radar source is a sphere, which in fact has a RCS equal to its physical area. The equivalent RCS of a sphere of the same area as the panel under test is shown on the scale in FIG. 5 at −7 dBsm. It can be seen that the panel performs on average nearly as well as a sphere and generally reduces the radar cross-section relative to a flat plate by 20 dBsm. The RCS is relatively uniform over the azimuth range, confirming the expectation that the panel has the effect of scattering incoming radiation approximately isotropically in all directions.

In practice, because of the limited number of reflecting elements making up a panel, the RCS trace as illustrated in FIG. 5 forms a succession of maxima and minima at a typical azimuth spacing of up to 20°.

In a further development of the invention, panels protecting a platform are mounted adjustably so that they can be pivoted relative to the underlying protected surface.

Computer controlled panel tilting actuators, as shown in FIG. 6, respond to the detected frequency and angle of incidence of an incoming radar signal to adjust the angle or tilt of the panels automatically so as to steer the nearest null or minimum in the reflection pattern for the panels on to the measured angle of incidence.

It should be understood that the RCS patterns for the panels used can be accurately determined over a range of likely frequencies and such information stored in computer memory so that the tilting of the panels can be appropriately controlled in active response to the detected radar signal.

In this way, the effective RCS of the panels can be substantially further reduced by perhaps up to 30 dBsm.

In the above described example of the invention, a screening panel is disclosed containing a two-dimensional orthogonal array of reflective elements. It should be understood that the invention may be incorporated into the design of the platform, vehicle or installation itself, providing the required differingly spaced reflective elements over susceptible surface portions of the platform without the need for additional screening panels. Further, in some applications, a one-dimensional array of reflective elements may be sufficient to protect an essentially one-dimensional target feature, such as the spar of a ship, or possibly the leading edge of the wing of an aircraft. In the latter case, the elements may be cylindrical and coaxial and have randomly differing diameters to produce the desired effect. To preserve aerofoil performance the element array can be filled with low loss low dielectric material with possibly a thin membrane covering or radome.

We claim:

1. A radar reflecting target comprising a plurality of planar and mutually parallel reflecting elements spread along at least one linear physical dimension of the target, the elements being randomly or pseudo-randomly spaced in the direction normal to said dimension so that respective retro-reflections by the elements of radio frequency energy from a remote source on a line sight at an angle to said dimension, have differing phases and tend to cancel each other out, the elements being randomly or pseudo-randomly spaced in said normal direction over at least one half wavelength of an expected radio frequency energy from the remote source.

2. A target as claimed in claim 1 wherein the reflecting elements are spread over two orthogonal physical dimensions of the target and are randomly or pseudo-randomly spaced normal to the plane of said orthogonal dimensions.

3. A target as claimed in claim 2 wherein the reflecting elements are electrically conductive plates arranged to appear substantially tesselated when viewed normal to said plane.

4. A target as claimed in claim 3 wherein said electrically conductive plates are mutually parallel and square.

5. A target as claims in claim 3 wherein the target is formed of a molded panel of dielectric material having flat surface portions bearing an electrically conductive film to form said reflecting elements.

6. A target claimed in claim 5 wherein said differingly spaced elements are distributed randomly or pseudo-randomly over the panel.

7. A target as claimed in claim 5 wherein said differingly spaced elements are distributed across the panel so as to provide a null for retro-reflection normal to said plane.

8. A target as claimed in claim 7 and including adjustable spacing means responsive to the measured frequency of radio frequency energy detected from a remote source to adjust said spacing normal to said plane of at least some of said differingly spaced elements to provide said null at the measured frequency.

9. A target as claimed in claim 2 and forming a screening panel for mounting on a radar reflecting surface.

10. A target as claimed in claim 9 providing for any frequency over a range of frequencies a plurality of retro-reflection minima at known retro-reflection angles relative to said plane defined by the screening panel, and including adjustable mounting means responsive to the measured frequency and angle of incidence of radio frequency energy detected from a remote source to adjust the angle of said plane relative to the radar reflecting surface so as to steer a retro-reflection minima on to said measured angle of incidence.

* * * * *